US008001644B1

(12) United States Patent
Martinez

(10) Patent No.: US 8,001,644 B1
(45) Date of Patent: Aug. 23, 2011

(54) CYMBAL POLISHING DEVICE AND METHOD

(76) Inventor: Albert S. Martinez, Ennis, TX (US)

( * ) Notice: Subject to any disclaimer, the term of this patent is extended or adjusted under 35 U.S.C. 154(b) by 878 days.

(21) Appl. No.: 11/875,890

(22) Filed: Oct. 20, 2007

Related U.S. Application Data

(60) Provisional application No. 60/855,031, filed on Oct. 27, 2006.

(51) Int. Cl.
*B24D 13/00* (2006.01)
*A47L 25/00* (2006.01)

(52) U.S. Cl. ..... 15/97.1; 84/422.3

(58) Field of Classification Search ..... 15/88.1, 15/88.2, 88.3, 97.1; 84/422.3
See application file for complete search history.

(56) References Cited

U.S. PATENT DOCUMENTS

| | | | | | |
|---|---|---|---|---|---|
| 2,439,466 | A * | 4/1948 | Gravley | 310/340 |
| 3,231,916 | A * | 2/1966 | Malenfant | 15/34 |
| 3,640,029 | A * | 2/1972 | Zildjian | 451/53 |
| 4,123,816 | A * | 11/1978 | Lupo | 15/88.3 |
| 4,202,071 | A * | 5/1980 | Scharpf | 15/302 |
| 4,222,204 | A * | 9/1980 | Benner | 451/494 |
| 5,253,383 | A * | 10/1993 | Clark | 15/88.3 |
| 7,199,297 | B2 * | 4/2007 | Anderson | 84/422.3 |
| 2001/0032369 | A1 * | 10/2001 | Taylor | 15/101 |

* cited by examiner

*Primary Examiner* — Randall Chin
(74) *Attorney, Agent, or Firm* — Eric Karich

(57) ABSTRACT

A cymbal polishing device has a base, a motor mounted on the base, and a shaft having a proximal end and a distal end. The distal end of the shaft is operably mounted to the motor so that the shaft can be rotated by the motor. A cymbal locking element at the proximal end of the shaft is adapted to removably lock a cymbal to the proximal end of the shaft so that the cymbal rotates with the shaft and the motor.

3 Claims, 5 Drawing Sheets

CYMBAL POLISHING DEVICE AND METHOD

CROSS-REFERENCE TO RELATED APPLICATIONS

This application for a utility patent claims the benefit of U.S. Provisional Application No. 60/855,031, filed Oct. 27, 2006.

STATEMENT REGARDING FEDERALLY SPONSORED RESEARCH

Not Applicable

BACKGROUND OF THE INVENTION

1. Field of the Invention

This invention relates generally to cleaning devices, and more particularly to a cymbal polishing device for polishing a cymbal.

2. Description of Related Art

Musical instruments such as cymbals require care and cleaning to maintain their proper acoustic properties. Cymbals also require cleaning so that they are visually appealing. A dirty cymbal looks dingy, while a properly polished cymbal shines brightly and provides a visual appeal as well as a pleasing sound.

Cymbals are currently polished by hand, a laborious process. For many musicians, especially professionals performing on stage, a great deal of labor must be expended polishing cymbals. Stores selling cymbals also must expend a great deal of effort polishing cymbals so that their products look good, despite being touched and smudged by customers.

The prior art teaches hand polishing of cymbals to increase their visual and acoustical appeal. However, the prior art does not teach a cymbal polishing device that facilitates the swift and easy polishing of cymbals, without the laborious effort of hand polishing. The present invention fulfills these needs and provides further related advantages as described in the following summary.

SUMMARY OF THE INVENTION

The present invention teaches certain benefits in construction and use which give rise to the objectives described below.

The present invention provides a cymbal polishing device for polishing a cymbal. The cymbal polishing device includes a base, a motor mounted on the base, and a shaft having a proximal end and a distal end. The distal end of the shaft is operably mounted to the motor so that the shaft can be rotated by the motor. A cymbal locking element at the proximal end of the shaft is adapted to removably lock the cymbal to the proximal end of the shaft so that the cymbal rotates with the shaft and the motor.

A primary objective of the present invention is to provide a cymbal polishing device having advantages not taught by the prior art.

Another objective is to provide a cymbal polishing device that facilitates the swift and easy polishing of cymbals, without the laborious effort of hand polishing.

A further objective is to provide a cymbal polishing device that enables musicians and others to maintain their cymbals in visually and acoustically pristine condition.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

The above-described drawing figures illustrate the invention, a cymbal polishing device 10 for polishing a cymbal 12. The cymbal polishing device 10 functions to rotate the cymbal 12 at a high speed to facilitate polishing the cymbal 12 without the strenuous effort required by manual polishing the cymbal 12. Cleaning and polishing the cymbal 12 on a regular basis is essential for both improving the appearance of the cymbal, and for restoring the full audio qualities of the cymbal.

Figure 1:
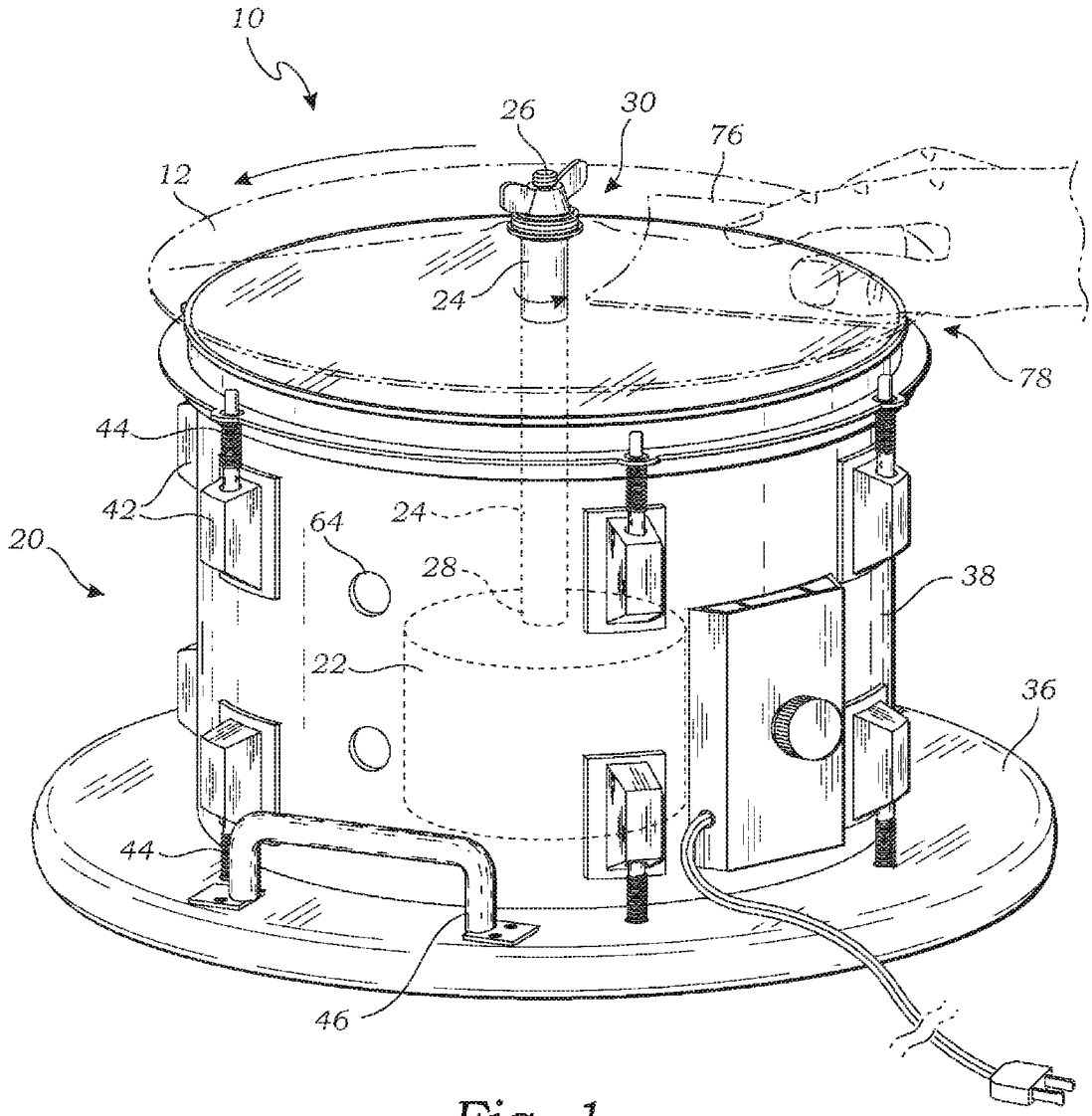
FIG. 1 is a perspective view of a cymbal polishing device according to a preferred embodiment of the present invention.

FIG. 1 is a perspective view of the cymbal polishing device 10 according to a preferred embodiment of the present invention. As shown in FIG. 1, the cymbal polishing device 10 includes a base 20, a motor 22 mounted on the base 20, a shaft 24, and a cymbal locking element 30.

The shaft 24 has a proximal end 26 and a distal end 28 with the distal end 28 operably mounted to the motor 22 such that the shaft 24 can be rotated by the motor 22. The cymbal locking element 30 removably locks the cymbal 12 to the proximal end 26 of the shaft 24 such that the cymbal 12 rotates with the shaft 24 and the motor 22.

As illustrated in FIG. 1, the base 20 may include a platform 36 and a housing 38 secured to the platform 36. The housing 38 of the cymbal polishing device 10 is designed to simulate a drum. In the preferred embodiment, the housing 38 is a drum-shaped shell with a plurality of lugs 42 attached and a plurality of tension rods 44 extending through the lugs 42. The platform 36 may also include handles 46 to facilitate handling the cymbal polishing device 10.

Figure 2:
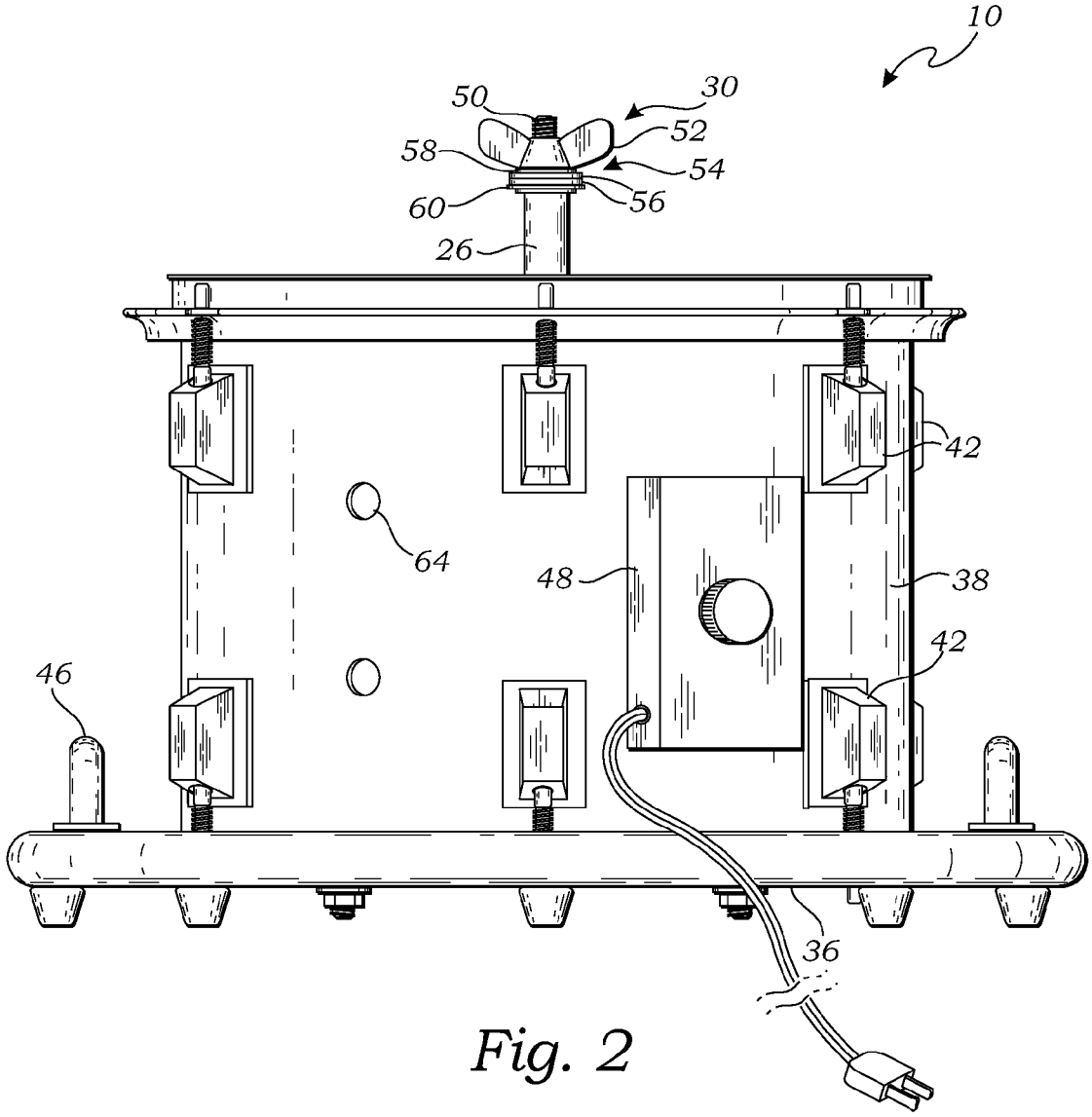
FIG. 2 is a rear elevational view thereof.

FIG. 2 is a rear elevational view of the cymbal polishing device 10. As shown in FIG. 2, the housing 38 may include a speed control element 48 such as a switch, dial, or similar component for the operative control of the device.

As shown in FIG. 2, the proximal end 26 of the shaft 24 may include an external threaded portion 50 designed to operably engage the cymbal locking element 30 which has a tightening element 52 internally threaded to engage the external threaded portion 50. In the preferred embodiment, the cymbal locking element 30 also has a cymbal securing element 54 adapted to engage the cymbal 12. The cymbal securing element 54 may include a pair of nonabrasive pads 56 adapted to abut the cymbal 12, a first spacing element 58 adapted to abut the tightening element 52 and one of the nonabrasive pads 56, and a second spacing element 60 adapted to abut the other nonabrasive pad 56.

In the preferred embodiment, the first and second spacing elements 58 and 60 are washers. The nonabrasive pads 56 are felt pads but they could consist of foam or any other nonabrasive material known in the art. The tightening element 52 is preferably a fastener such as a wing nut but may be a bolt, clamp, or equivalent fastening element used in the art. The cymbal 12 is sandwiched between the felt pads 56, which grip the cymbal 12 without damaging it, and the wing nut 52 is tightened to clamp the cymbal 12 there between as shown in FIG. 1.

Figure 3:
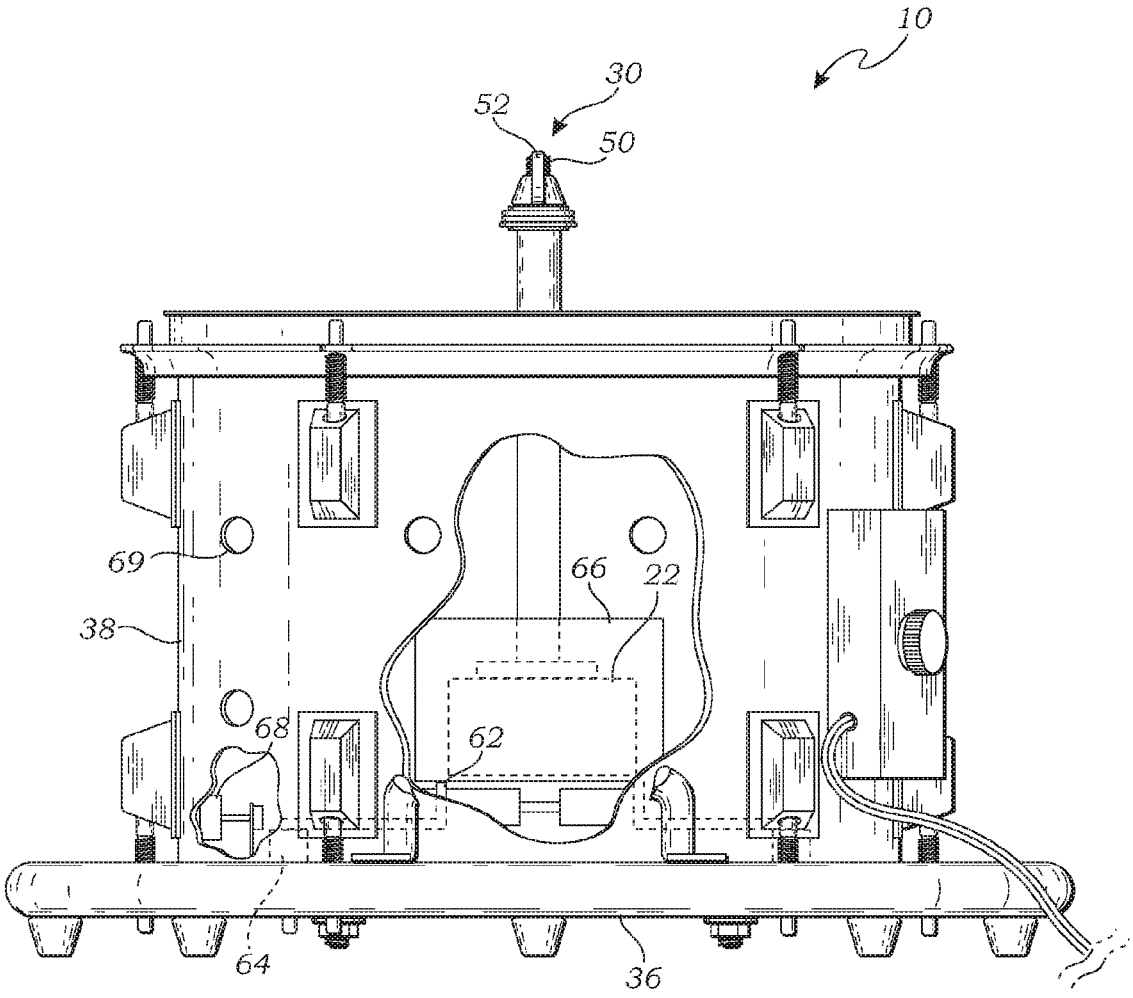
FIG. 3 is a front elevational view thereof, with a housing of the cymbal polishing device being cut away to illustrate the internal components of the cymbal polishing device.

FIG. 3 is a front elevational view of the cymbal polishing device 10, with the housing 38 being cut away to illustrate the internal components of the cymbal polishing device 10. As shown in FIG. 3, the motor 22 is mounted on the base 20. The motor 22 is preferably a ¾ horse power direct drive blower motor, although a variety of motors may be selected by those skilled in the art.

In the preferred embodiment, the motor 22 is mounted to the base 20 with a motor securing element 62 and a vibration absorbing element 64. In the present invention, the motor securing element 62 is a set of motor mounting brackets and the vibration absorbing element 64 is rubber bushings. The bushings 64 function to absorb vibrations and other stresses placed on the motor 22 during the polishing process. The motor 22 also may include a cooling element 66 such as a cooling fan, blower wheel, or other cooling device known in the art.

The cymbal polishing device 10 may include a capacitor 68 operably connected to the motor 22 for providing additional power when required, and a venting element 69 to prevent the motor 22 from overheating during use.

Figure 4:
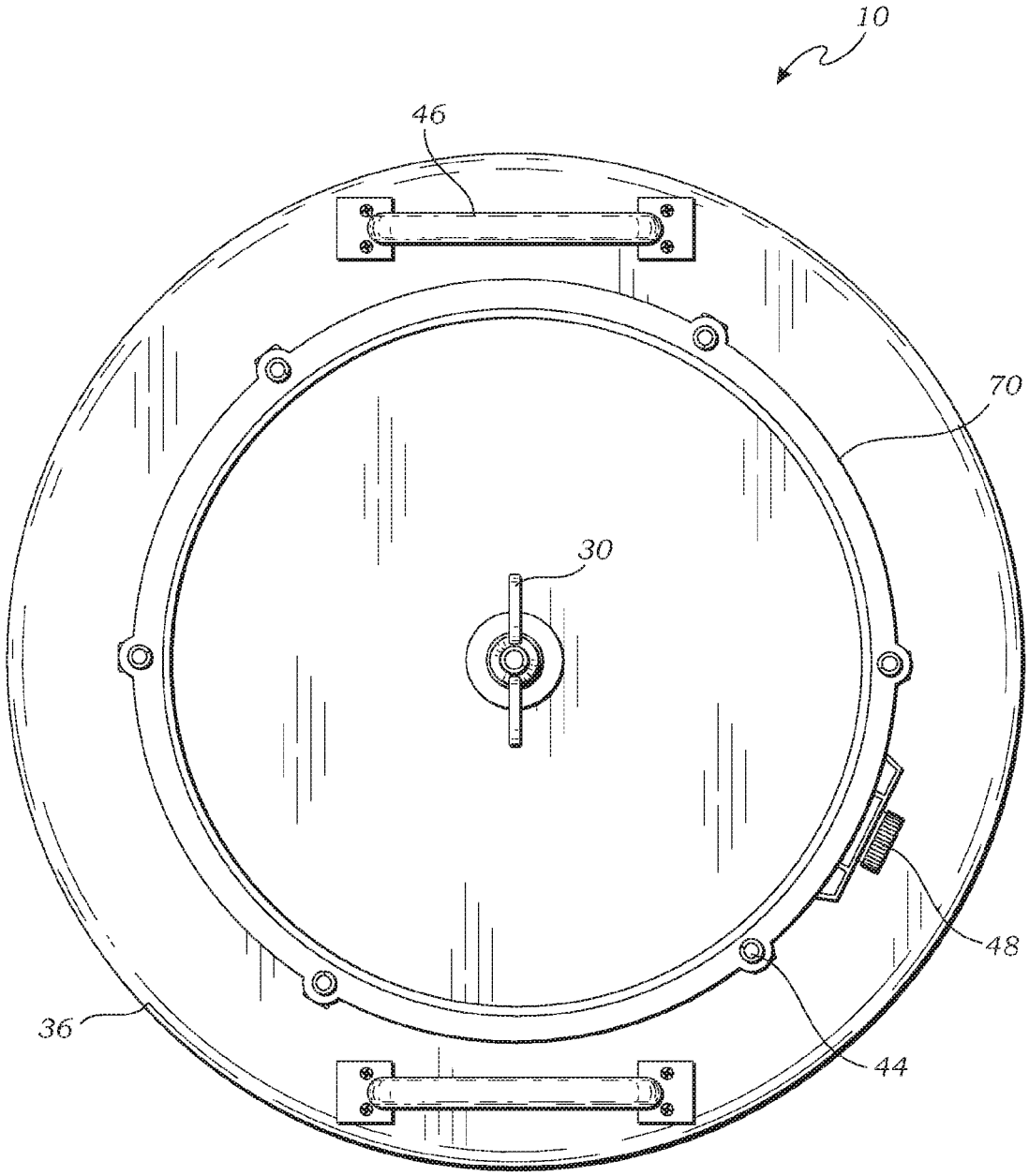
FIG. 4 is a top plan view of the cymbal polishing device.

FIG. 4 is a top plan view of the cymbal polishing device 10. As illustrated in FIG. 4, the device may include a plurality of decorative elements 70 such as a drum head, a metal drum hoop, or other features to enable the device to further resemble a drum, for decorative purposes.

Figure 5:
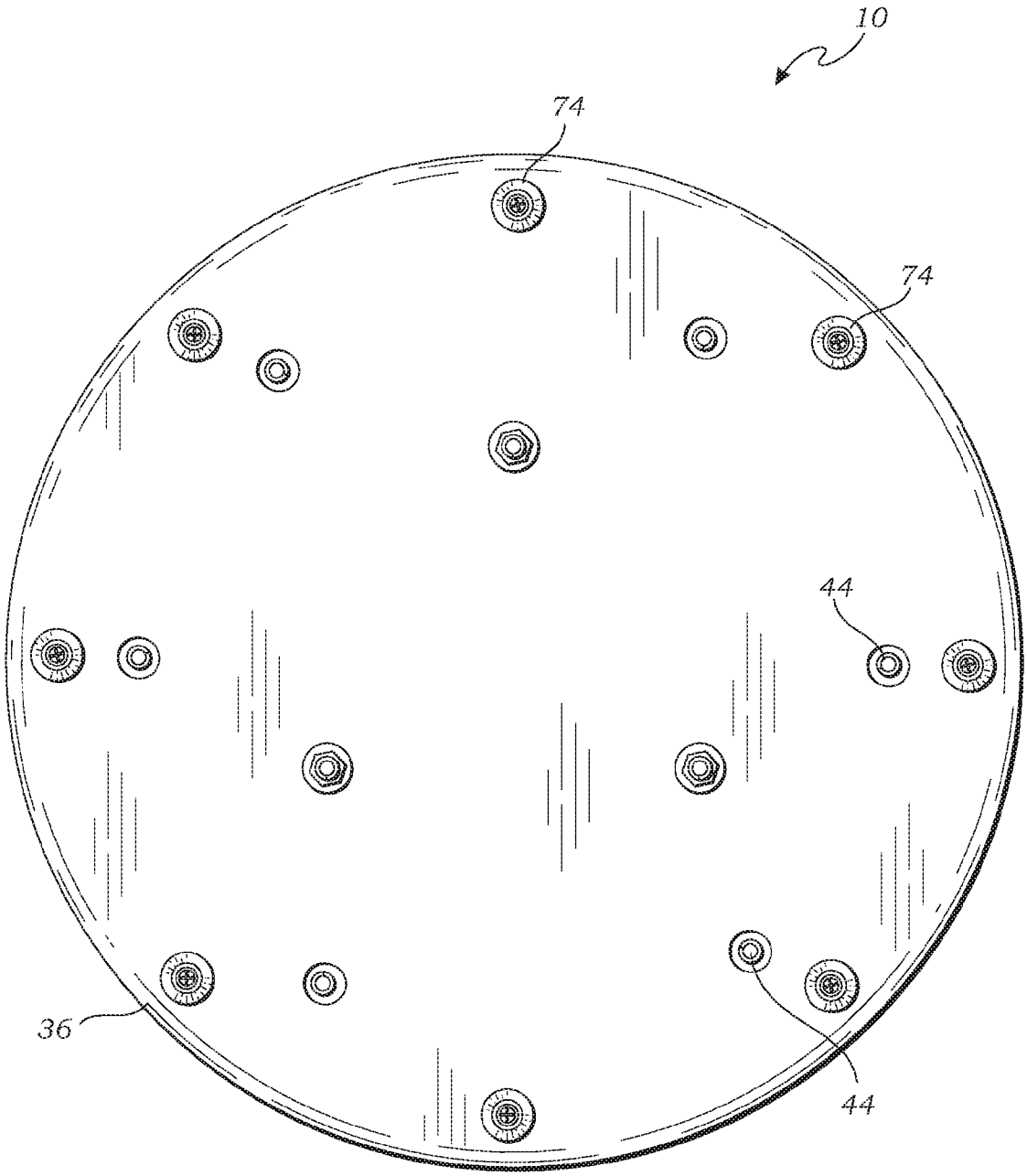
FIG. 5 is a bottom plan view thereof.

FIG. 5 is a bottom plan view of the device. As illustrated in FIG. 5, the base 20 may include a bumper pad element 74 for further dampening stresses placed on the motor 22 during use of the device.

The invention includes a method for polishing a cymbal 12 using the cymbal polishing device 10. The method includes providing the cymbal polishing device 10 including the base 20, motor 22, and shaft 24. The cymbal 12 is mounted on the proximal end 26 of the shaft 24. The motor 22 is run to rotate the shaft 24, thereby rotating the cymbal 12.

As shown in FIG. 1, a cloth 76 is provided and the cloth 76 is impregnated with a polishing solution 78. The cloth 76 is then pressed against the cymbal 12 such that rotation of the cymbal 12 causes the cymbal 12 to be polished by the cloth 76 and the polishing solution 78. For purposes of this invention, the term cloth 76 is defined to include any form of cloth, paper towel, sponge, felt pad, or similar or equivalent cleaning element.

For purposes of this application, the term polishing solution 78 is defined to include any form of polishing, cleaning, or stripping chemicals or solutions that might be desirable for cleaning and/or polishing the cymbal 12. While the method describes first impregnating the cloth 76 with the solution, these terms are expressly defined herein to include alternative method of application, such as applying the solution to the cymbal 12 and then rubbing the cloth 76 over the cymbal 12, thereby impregnating the cloth 76 with the solution.

The terminology includes the words described above, similar or equivalent words, and derivatives thereof. Additionally, the words "a," "an," and "one" are defined to include one or more of the referenced item unless specifically stated otherwise. Also, the terms "have," "include," "contain," and similar terms are defined to mean "comprising" unless specifically stated otherwise.

While the invention has been described with reference to at least one preferred embodiment, it is to be clearly understood by those skilled in the art that the invention is not limited thereto. Rather, the scope of the invention is to be interpreted to include similar, alternative, and/or equivalent components and structures, and other structures that may be devised by those skilled in the art in light of the present invention.

What is claimed is:

1. A cymbal polishing device for polishing a cymbal, the comprising:

a base;

a motor mounted on the base;

a shaft having a proximal end and a distal end, the distal end being operably mounted to the motor such that the shaft can be rotated by the motor;

a cymbal locking element for removably locking the cymbal to the proximal end of the shaft such that the cymbal rotates with the shaft and the motor;

wherein the proximal end of the shaft includes an external threaded portion designed to operably engage the cymbal locking element;

wherein the cymbal locking element includes a tightening element adapted to secure a cymbal securing element to the proximal end of the shaft; and wherein the cymbal securing element includes:

a pair of nonabrasive pads adapted to abut the cymbal;

a first spacing element adapted to abut the tightening element and one of the nonabrasive pads; and a second spacing element adapted to abut the other nonabrasive pad.

2. A cymbal polishing device for polishing a cymbal, the comprising:

a base;

a motor mounted on the base;

a shaft having a proximal end and a distal end, the distal end being operably mounted to the motor such that the shaft can be rotated by the motor;

a cymbal locking element for removably locking the cymbal to the proximal end of the shaft such that the cymbal rotates with the shaft and the motor; and wherein the base includes a platform and a housing surrounding the motor secured to the platform, the housing including:

a drum-shaped shell;

lugs attached to the drum-shaped shell; and tension rods extending through the lugs.

3. The cymbal polishing device of claim 2, wherein the tension rods extend down from the lugs and through the platform such that the tension rods secure the housing to the platform.

* * * * *